United States Patent [19]

Glaser

[11] 4,440,312

[45] Apr. 3, 1984

[54] VENDING MACHINE WITH FRONT DISPLAY AREA

[75] Inventor: Robert L. Glaser, Deerfield, Ill.

[73] Assignee: L. M. Becker & Co., Inc., Appleton, Wis.

[21] Appl. No.: 324,798

[22] Filed: Nov. 25, 1981

[51] Int. Cl.[3] ..... G07F 11/44

[52] U.S. Cl. ..... 221/24; 221/265; 221/281

[58] Field of Search ..... 221/3, 24, 281, 265, 221/203; 194/63; 222/78; 312/117, 118, 121, 124, 204; 280/43.1, 47.13 R, 47.12, 47.26

[56] References Cited

U.S. PATENT DOCUMENTS

| | | | |
|---|---|---|---|
| 825,555 | 7/1906 | Pool | 221/24 |
| 868,632 | 10/1907 | Almstrom et al. | 221/3 |
| 893,203 | 7/1908 | Smith | 194/63 |
| 909,148 | 1/1909 | Cameron et al. | 312/121 |
| 2,288,759 | 7/1942 | Welton | 312/118 X |
| 2,990,975 | 7/1961 | Sereno | 221/203 |
| 3,081,908 | 3/1963 | Siegfried | 221/265 X |
| 3,822,004 | 7/1974 | Bolen | 221/3 X |
| 3,894,657 | 7/1975 | Eckmayr | 221/265 |
| 4,350,264 | 9/1982 | Muller | 221/281 X |
| 4,351,539 | 9/1982 | Rodolakis | 280/47.26 |

OTHER PUBLICATIONS

An Advertising Flyer of Bulk Mfg. Co., Inc., Undated, Admitted Prior Art, Showing the "Lucky Eggs" Vending Machine.

An Advertising Flyer of Movie Hut, Inc., Undated, Admitted Prior Art, Showing the "Fun Chicken!" Vending Machine.

A Prior Art Brush Off Plate.

*Primary Examiner*—F. J. Bartuska

*Attorney, Agent, or Firm*—Quarles & Brady

[57] ABSTRACT

A vending machine having a merchandise chamber for a flowable body of merchandise items of a selected normal depth is disclosed. The chamber is defined by a bottom wall, a top wall, a vertical front wall that is at least partially transparent, and vertical side walls. A mechanized dispenser near the bottom of the chamber dispenses the merchandise to the exterior of the chamber, and a display is positioned behind the front wall and above the normal merchandise depth. In one preferred embodiment, there is a vertical hopper partition extending between the side walls behind the display to divide the merchandise chamber into a front display chamber and a rear hopper that extends above the normal merchandise depth. The front display chamber is suitable for storing a plurality of such merchandise items. The bottom of the partition is spaced above the bottom wall a distance corresponding to the normal merchandise depth so as to allow the front display chamber to be kept at a stable level. There is also provided an external loading aperture near the top of the hopper.

4 Claims, 8 Drawing Figures

17
39
40
83
22
21
33
84
32
40
80
27
29
30
26
41
25
77
83
84
23
31
37
81
82
24
76
89
14
42
74
38
35
7
7
12
13
10
49
16
20
18

Fig. 6
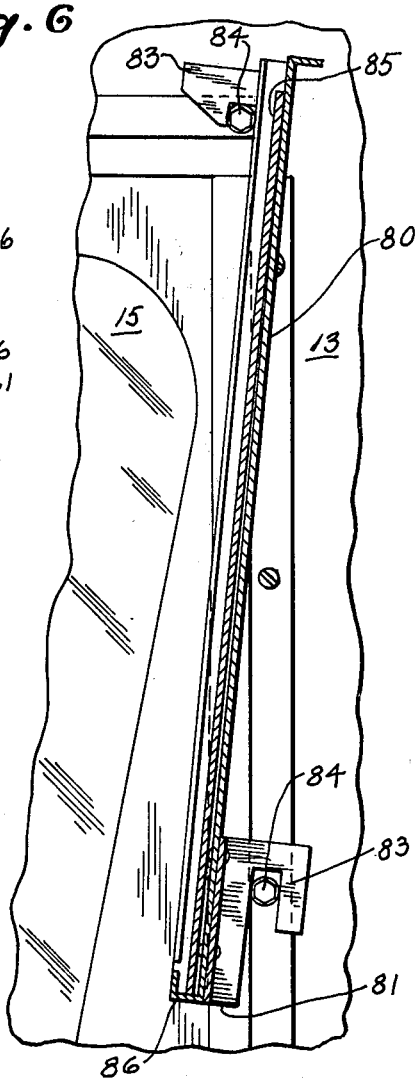
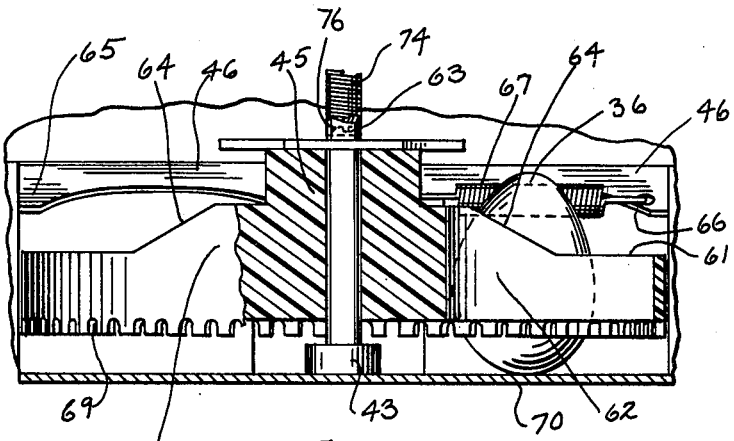
Fig. 8
Fig. 7
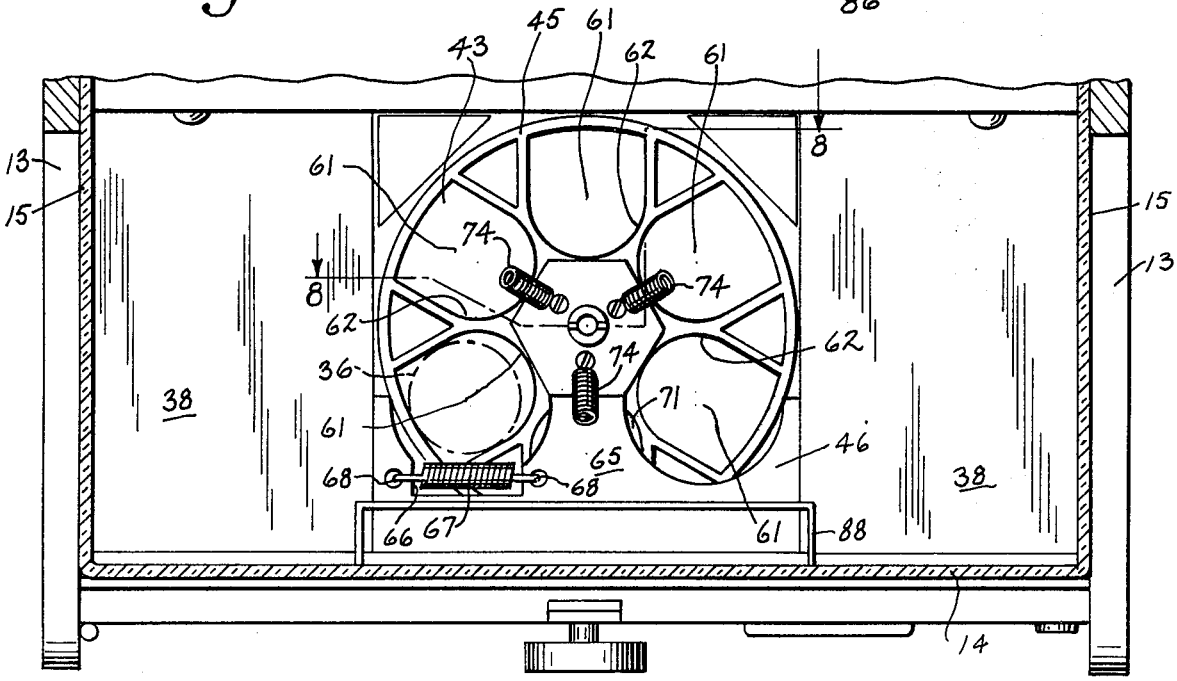

VENDING MACHINE WITH FRONT DISPLAY AREA

BACKGROUND OF THE INVENTION

1. Field of the Invention

The present invention relates to vending machines, and more particularly to bulk vending machines which dispense a flowable body of merchandise from a merchandise storage chamber to the exterior of the machine. It is particularly well adapted to be used in conjunction with vending machines having audio and visual displays for attracting the attention of customers.

2. Description of the Art

It is conventional to construct vending machines that have a merchandise storage chamber with one or more walls that are transparent. This allows the merchandise to be displayed to potential customers as it is being stored. Such machines often dispense merchandise through a dispensing mechanism located under the merchandise. However, where storage chambers of substantial height are used to increase the storage capacity, the weight of the merchandise on the dispensing mechanism can cause the merchandise to jam the mechanism. Such jamming may require a service call to free the mechanism and may even harm the mechanism. Jamming may also cause merchandise to break and then be vended in a broken condition. The maximum storage height of the merchandise may also be limited by an internal display which is often positioned above the merchandise in the storage chamber to attract customer attention.

Another consideration in constructing a vending machine is that for ease of servicing and installation, it is desirable to have machines which can easily be transported from one area to another. However, where conventional visible wheels are attached to the machine, vandals may become aware that the machine can be easily transported, and the machine may then be moved by unauthorized persons.

Still another concern of the vending machine industry is that while certain displays, e.g. a Christmas motif, may be appropriate to attract customers during one portion of the year, such displays may be totally inappropriate at other times. It is therefore desirable to have a machine which allows machine owners to easily change displays without the need for a service call.

Other problems found in prior art vending machines related to resistance to vandalism and ease of repair. Because vending machines are often left unattended, they are targets of vandalism and theft. It is therefore desirable to construct vending machines which are both resistant to vandalism, and which can easily be disassembled and repaired when vandalized or when routine maintenance is needed.

It can therefore be seen that the need has existed for a vending machine which has a larger storage capacity for merchandise (for any given floor space which is used), a low rate of merchandise breakage and jamming, an internal display which can easily be removed and changed to meet seasonal needs, and relatively simple construction such that repairs can be easily and relatively inexpensively made. Further, the machine should be resistant to vandalism and easily transportable on wheels which are concealed from the public.

SUMMARY OF THE INVENTION

The invention provides a vending machine having a merchandise storage chamber for a flowable body of merchandise of a selected normal depth. In the preferred embodiment, the storage chamber comprises a bottom wall, a top wall, a vertical front wall that is at least partially transparent, and a plurality of vertical sidewalls. A dispensing means is mounted in the bottom wall below the merchandise and behind the front wall for dispensing items of merchandise to the exterior of the chamber, and a display member is positioned in the chamber above the normal merchandise depth.

There is also a vertical hopper partition between two sidewalls. The partition is positioned behind the display member and dispensing means to form a rear hopper for extra merchandise that extends above the normal merchandise depth. The bottom of this partition is upwardly spaced from the bottom wall of the chamber a distance corresponding to the normal merchandise depth to define a passage between the hopper and a forward portion of the chamber. A loading aperture is formed in a wall of the chamber above the normal merchandise depth to allow merchandise to be introduced from the exterior of the chamber into the hopper.

A loading door can be positioned over the loading aperture to form a feeding chute to the hopper, and the partition can be removably mounted on opposed vertical side walls of the chamber by a pivot connection. The partition may then be pivoted rearwardly and downwardly between the opposed vertical sidewalls to allow easy removal and change of the display through the loading aperture.

When a flowable body of merchandise is loaded into the hopper, it flows into the forward portion of the chamber until the merchandise level reaches the top of the passage (the selected normal depth). The use of the partition limits the weight of merchandise over the dispensing means by holding any additional merchandise which is added above the selected normal depth in the hopper section. Merchandise is then slowly fed into the front portion as the merchandise is vended. This construction lowers the risk of jamming and breakage, while in addition provides added storge capacity when a display is used.

As a further improvement, wheels are attached at the bottom of the machine adjacent the rear corners of the machine, and the side walls of the machine are specially constructed to act as a shroud for the wheels while at the same time allowing the machine to be easily tipped back on the wheels when the machine is to be transported. A special vending wheel and brush off plate construction is also disclosed to further lower the likelihood of jamming and breakage.

In an especially preferred form, the dispensing means is positioned in a replaceable cartridge unit which is removably mounted on the sidewalls of the machine housing. Other components of the machine, such as the transparent front wall and the front door of the machine, may also be formed to be separately removable from the housing for ease of installation and repair. The elements of the machine are interlocking to provide for a vandal resistant construction.

The objects of the invention therefore include:

(a) providing a vending machine of the above kind which has a large storage capacity;

(b) providing a vending machine of the above kind which reduces the likelihood of jamming of the dispensing mechanism and breakage of the merchandise;

(c) providing a vending machine of the above kind which is easily transportable in a manner which is normally concealed from the public;

(d) providing a vending machine of the above kind which is vandal resistant and allows for easy and relatively inexpensive repair of broken and worn out parts; and (e) providing a vending machine of the above kind which allows displays positioned in the storage chamber to be easily changed by machine owners.

These and still other objects and advantages of the invention will be apparent from the description which follows. The preferred embodiments of the invention will be described in reference to the accompanying drawings. These embodiments do not represent the full scope of the invention, but rather the invention may be employed in other embodiments. Reference should therefore be made to the claims herein for interpreting the breadth of the invention.

BRIEF DESCRIPTION OF THE DRAWINGS

FIG. 6 is an enlarged sectional view of the removable partition of FIG. 5 shown attached to a side wall of the vending machine;

FIG. 7 is a sectional view taken along plane 7—7 in FIG. 5 in the direction of the arrows, showing a piece of merchandise about to be vended; and FIG. 8 is a partial sectional view taken along plane 8—8 in FIG. 7 in the direction of the arrows.

DESCRIPTION OF THE PREFERRED EMBODIMENT

Figure 1:
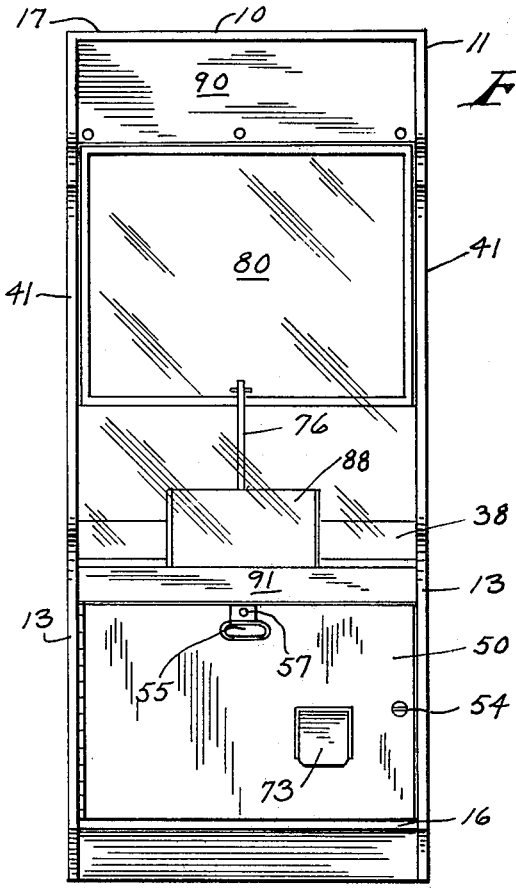
FIG. 1 is a front elevational view of a vending machine embodying the present invention.

Referring now to FIGS. 1-4, there is shown a vending machine 10 which has an outer housing 11 comprising a vertical rear housing wall 12, opposed vertical housing side walls 13, and a transparent front closure 14. Transparent extensions 15 from front closure 14 also form part of the sidewalls 13. The rear wall 12, side walls 13 and front closure 14 are shown as essentially perpendicular to the ground, but they may also be formed to extend vertically upward at other angles with respect to the ground.

To complete the housing 11, there is a housing base 16 and a top 17. The top 17 can be slanted downwardly towards the rear of the machine to discourage people from placing items on top of the machine.

Figure 3:
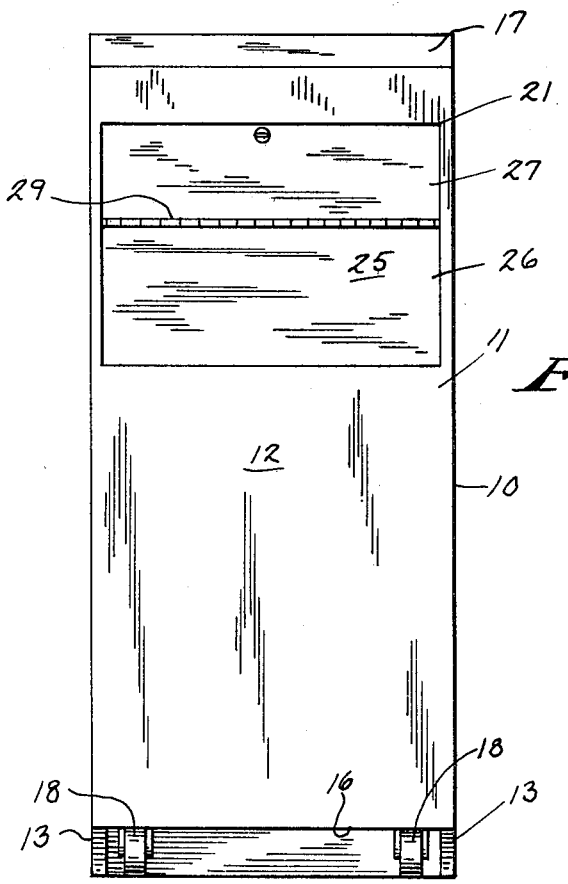
FIG. 3 is a rear elevational view of the vending machine of FIG. 1.
Figure 4:
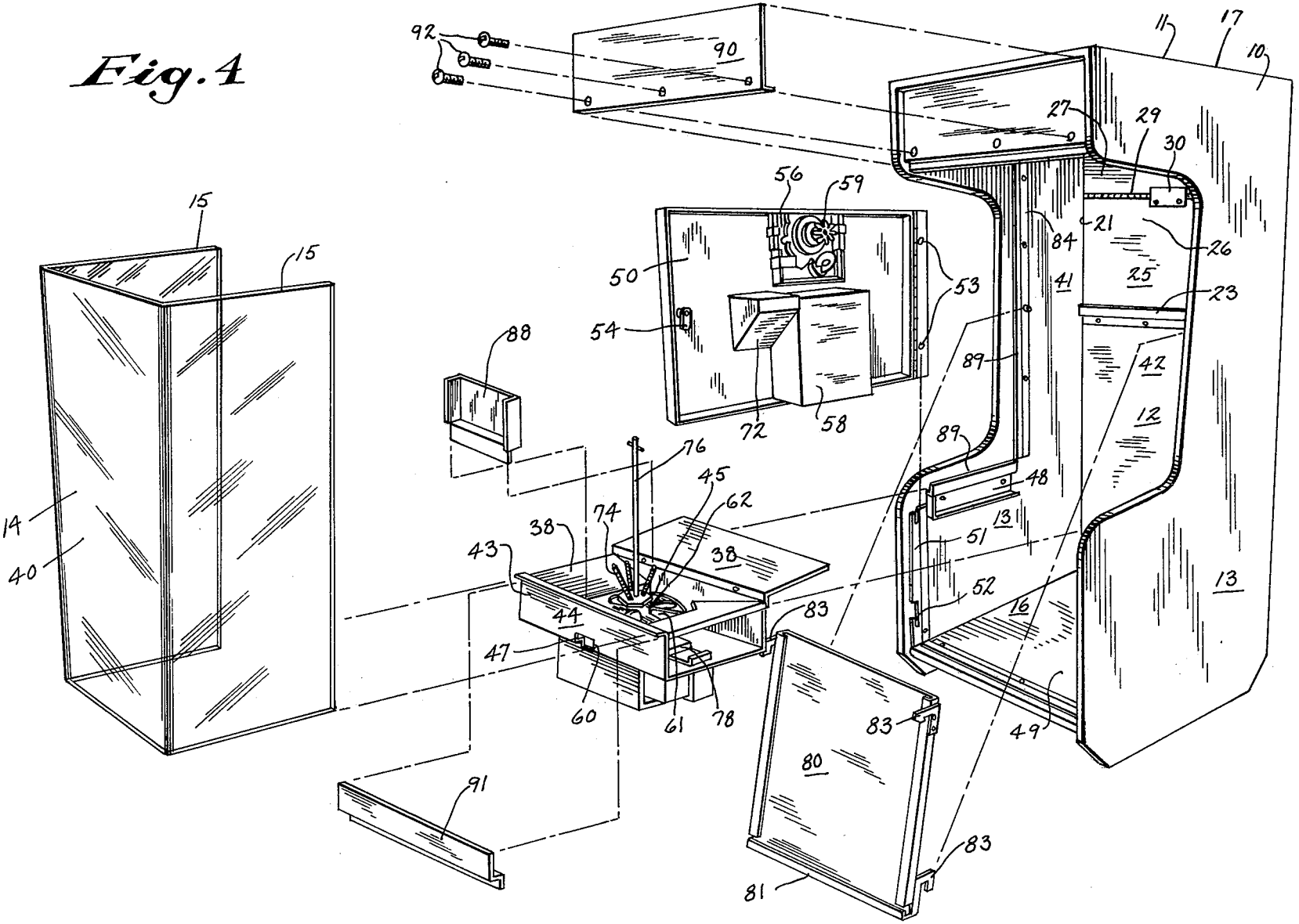
FIG. 4 is an exploded perspective view of the vending machine of FIG. 1.
Figure 5:
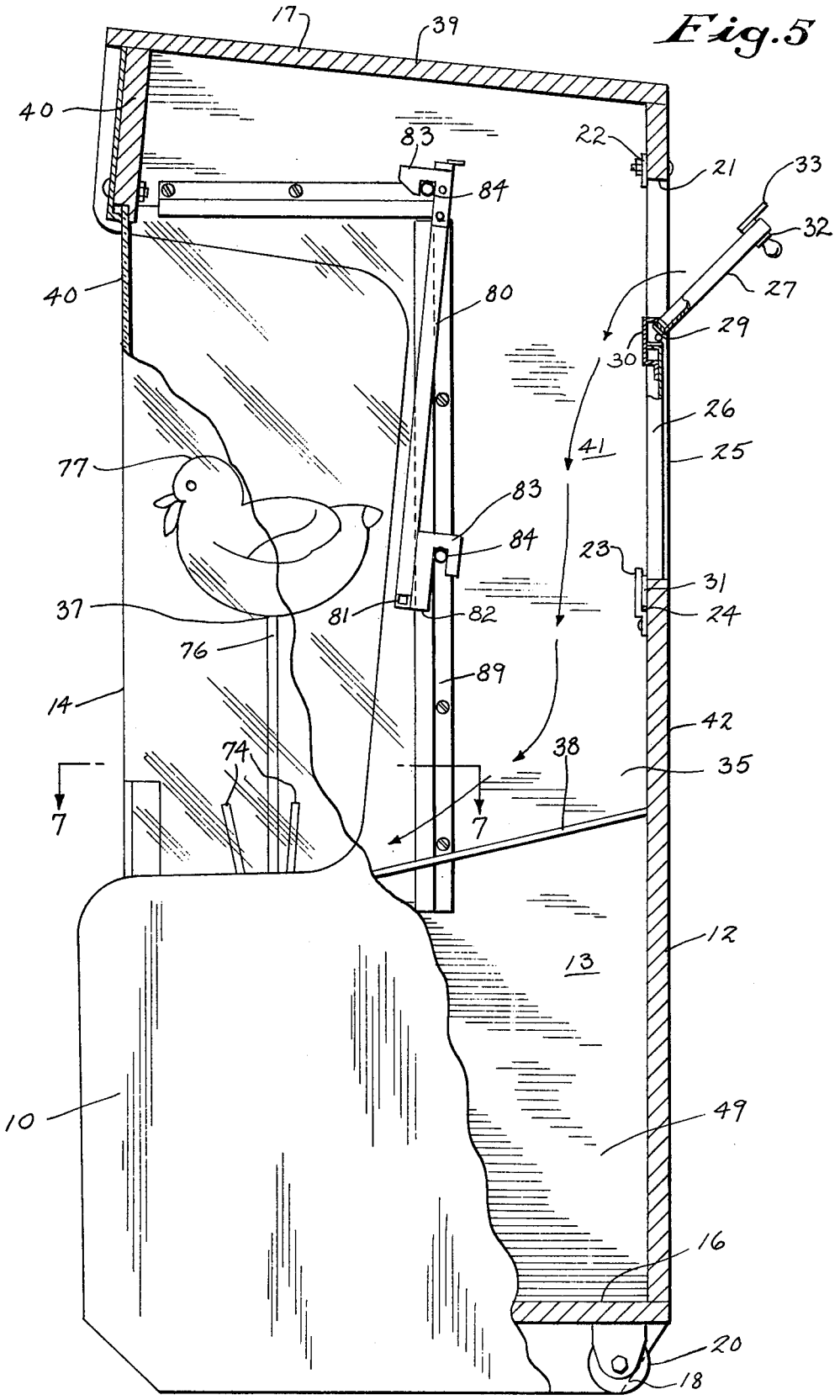
FIG. 5 is a view similar to FIG. 2, showing the machine without merchandise, with a side wall partially broken away, and with portions of the interior of the machine in section.

As can be seen from examining FIGS. 3 and 5, a wheel 18 is mounted on the housing base 16 adjacent the intersection of each housing side wall 13 with the rear wall 12. Side walls 13 extend rearwardly at point 19 beyond the back end 20 of the wheel 18. Also, side walls 13 extend downwardly below the top of the wheels 18 to partially hide the wheels when the machine is viewed from the side. When the machine is viewed from an angle such as FIG. 4 (a viewing angle which a typical purchaser might have), the recessed wheels are completely concealed from view.

Near point 19 of side wall 13, the lower rear corner of the side walls 13 are cut away. Because of this recessed wheel construction, the machine may be readily tipped backward onto the wheels 18, and transported thereon without the need for a separate dolly to move the machine.

Turning now to FIGS. 3 and 5, it will be seen that the machine has a loading aperture 21 formed in the rear wall 12. Adjacent to the aperture 21 are an upper bracket 22 and a lower bracket 23. Space 24 is formed between the lower bracket 23 and the rear wall 12. Similarly, there is a small lock receiving pocket (not shown) in the bottom of the upper bracket 22.

A loading door 25 is also provided. It has a lower panel section 26 which covers the bottom portion of the loading aperture 21, and a upper panel section 27 which is pivotably mounted to the lower panel section 26. The upper panel section 27 may be swung from a position covering the remainder of the loading aperture (see FIG. 3) to a position where the upper panel section 27 forms a feeding chute for the machine (FIG. 5).

Pivoting of the upper section 27 with respect to the lower panel section 28 is controlled by a hinge and bracket connection. Hinge 29 connects the two panel sections and bracket 30 is provided to restrict pivotable movement in a range of approxiately 45 degrees. Bracket 30 has a "U" shaped cross section, one part of which is connected to the lower panel 26, and the other part of which exends above an inwardly turned edge of the upper panel 27 to limit its movement.

It should be noted that lower panel section 26 has a downward extension 31 which removably slides into slot 24, and that upper panel section 27 has a lock mechanism 32. By turning a key in the lock 32, extension member 33 on lock 32 can be caused to move in and out of the lock receiving pocket in the upper bracket 22 when the door 25 is in the position shown in FIG. 3. This locks and unlocks the loading door.

Loading door 25 can also be removed completely from the rear wall 12 by unlocking the top panel section 27, swinging it outward, and then pulling the lower panel section 26 up out of slot 24. This will allow a user to easily load merchandise through the entire loading aperture 21 into the machine to a first level. Then, the lower panel section 26 can be inserted in the slot 24, and the door 25 can be placed in the position shown in FIG. 5 to allow loading of additional merchandise into the machine with the upper panel section 27 acting as a feeding chute. When the additional merchandise has been added, the door 25 can then be locked in the position shown in FIG. 3.

As best seen in FIG. 5, merchandise 36 is loaded into a merchandise storage chamber 35 up to a selected normal depth 37. The chamber is defined by a sloped bottom wall 38, a top wall 39 (top wall 17), a vertical front wall 40 (which includes the transparent housing front closure 14), a plurality of vertical side walls 41 (the top part of vertical housing side walls 13 and also the side extensions 15) and the rear 42 of the machine (top part of rear wall 12).

A dispensing means 43 is positioned behind the front closure 14 in the bottom wall 38 for dispensing items of merchandise 36 from the merchandise chamber 35 to the exterior of the machine. It is housed in a replaceable cartridge unit 44. The top portion of the dispensing means 43 forms a part of the sloped bottom wall 35. The dispensing means also has a rotatable vending wheel 45 adjacent the bottom chamber wall 38, a brush off plate 46 (see FIGS. 7 and 8) above a portion of the vending wheel 45 for aligning merchandise about to be vended, and internal gearing means 47 for controlling activation of the dispensing means.

As can best be seen in FIG. 4, cartridge unit 44 may be slid onto the top of horizontal ledges 48 formed on the vertical housing side wall 13 and removably supported thereon. In this portion, the bottom of the cartridge unit 44 (and the lower surface of the portion of bottom wall 38 extending rearwardly therefrom) define the top of an additional storage compartment 40 above the base 17. Extra displays which are not in use, and extra merchandise can be stored in this lower compartment.

A front door 50 is also provided. The door is removably attached to one vertical side wall 13 by bracket 51. This bracket has vertical slots 52 for receiving and holding pins 53 on the front door. There is also a hinge separating two portions of the door, and allowing the door to be swung closed to the position shown in FIG. 1. A front door lock mechanism 54 is also provided. It can mate with an appropriate receiving bracket on the other side wall 13 when the front door 50 is closed to securely close the extra storage compartment 49.

Crank 55 extends outward from the door 50 together with an appropriate coin mechanism 56 of conventional construction. When a purchaser wishes to purchase an item, the purchaser places a coin in slot 57 in the mechanism. The user is then able to turn the crank 55 to cause the coin to pass into the coin receptor box 58 on the back of the door 50.

The crank 55 also causes gear element 59 on the back of the door to turn. When door 50 is in the closed position, the gear element 59 projects through hole 60 of cartridge unit 44, and it meshes with the gearing means 47 of the dispensing means 43.

Turning now to FIGS. 7 and 8, the vending wheel 45 has six regularly spaced dispensing holes 61 extending axially through it. The dispensing holes 61 are separated along part of their periphery by divider walls 02 which are directed radially outward from the turning axis 83 of the wheel 45, and upward from the top surface of the wheel. The radially outward ends 64 of the divider walls 62 slope downwardly.

A brush off plate 65 is shown mounted above a portion of the vending wheel 45. The brush off plate 65 has a slot 66 for receiving merchandise about to be dispensed, and a resilient alignment boss or spring 67 which is anchored to opposite sides 68 of the slot 66.

Figure 2:
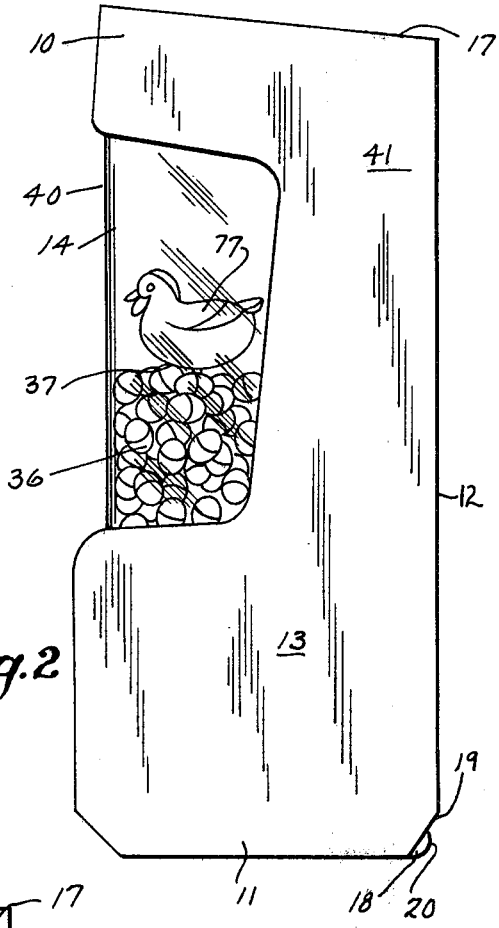
FIG. 2 is a side elevational view of the vending machine of FIG. 1, but shown loaded with merchandise and with a display positioned above the merchandise.

When merchandise is loaded in the machine as shown in FIG. 2, and the purchaser has activated the dispensing means 43 as described above, the gearing means 47 in the dispensing means 43 meshes with teeth 69 which are formed on the bottom of the vending machine 45 (see FIG. 8) thereby causing the wheel to rotate 1/6 of a revolution per turn of the crank 55.

When the machine is full, there will usually be merchandise 36 in five of the dispensing holes 61, as well as numerous other pieces of merchandise piled on top of the wheel 45. However, no merchandise will be vended until the crank is turned because below the vending wheel there is a support plate 70 (see FIG. 8) which supports the merchandise in the slots 61. Nevertheless, there is a vending hole 71 formed in the support plate 70 directly below the center of the brush off plate.

Thus, if a piece of merchandise (such as the piece shown in FIG. 7) is moved 60 degrees counterclockwise, it will be brought into alignment with the vending hole 71, and the merchandise will then drop into chute 72 on the front door 50, and through flap 73 on the outside of the door when the flap is opened by a purchaser. As discussed above, by turning the front crank 55, the vending wheel will in fact move the merchandise 60 degrees counterclockwise, thereby vending one piece of merchandise at a time.

A number of features are provided to minimize the likelihood that merchandise will be broken or become jammed against the sides of the brush off plate as it is vended. When at elongated piece of merchandise such as the plastic toy egg shown in FIG. 8 is to be vended, it must first be guided into a vending hole 61, then be pushed onto its side so that the tip of the merchandise will not jam against the side of the brushoff plate. Springs 74 are mounted on top of the vending wheel 45 to resiliently stir the merchandise as the vending wheel turns so as to assist the merchandise in aligning over holes 61. The downwardly sloping ends 64 of the divider walls 62 then assist in guiding merchandise into the dispensing holes 61. Spring 67 will finally act to gently and resiliently push the merchandise on its side as it passes under the brush off plate 65.

An entertaining display, such as a chicken 77, can be mounted on support 76, and the support can be connected on or through the vending wheel 45. Display 77 can be either separately connected to the gearing means 47 to rotate a full revolution while the vending wheel rotates only 1/6 of a revolution, or the display 77 and vending wheel 45 can be connected to rotate as a unit. Gearing means 47 can also be attached to a conventional electronic sound device 78. Thus, when the purchaser turns the crank 55, the purchaser will then hear an entertaining noise along with seeing the display move.

In the preferred embodiment, there is also a vertical hopper partition 80 mounted between two side walls 13, the partition being positioned behind the dispensing means 43 to form a rear hopper that extends above the normal depth of the merchandise 37. The bottom of the partition 81 is upwardly spaced from bottom wall 38 a distance corresponding to the normal merchandise depth at 37, and the hopper partition 80 thus defines a passage 82 (see FIG. 5) between the rear hopper portion of the merchandise storage chamber and the forward or display portion of the chamber 35.

Partition 80 is constructed with a set of four hooks 83 which hook onto projecting pins 84 extending from the side walls 13. Preferably, bottom hooks 83 are longer than top hooks 83 so that partition 80 may be raised slightly to free only the top hooks 83, and then pivoted rearwardly and downwardly between the opposed side walls 13 on the lower hook and pin connection. By raising the partition 80 even more, it may be completely detached from the side walls 13 and removed through the loading aperture 21 in the rear wall 12 when the loading door 25 is removed.

A second display such as a painting can be permanently placed on the front of partition 80, or in the alternative, as shown in FIG. 6, a poster 85 can be inserted into a three sided frame 86 which is formed as part of partition 80. Poster 85 can be easily removed throuth the loading aperture 21, and replaced with another poster. The frame can also be made wide enough so that several posters can be stored behind the one on display.

Assembly of the machine from the position shown in FIG. 4 is quite simple. One first places the cartridge unit 44 on the ledges 48 and the rearward extension of the bottom chamber wall 38 against the rear wall 12. Appropriate screws can be used to hold the cartridge unit rigidly in this position. Side extensions 15 of front closure 14 can then be slid into receiving slots 89 between various brackets mounted on the side walls 13 and the side walls. Closure 14 then is clamped in place with appropriate front plates 90 and 91, and bolts 92 (see FIGS. 4 and 5). Front door 50 can then be hooked into the brackets 51 and locked closed. An additional display can be mounted in a frame 88 affixed near the front of cartridge 44.

By removing rear door 25, the partition 80 and accompanying poster 85 can then be inserted in the housing and mounted on the side walls 13 in the position shown in FIG. 5. Merchandise is when added through the loading aperture 21 up to the level 37. The merchandise follows the path of the arrow in FIG. 5 from the loading aperture to the front of the machine due to the downwardly sloped configuration of the bottom chamber wall 38 and gravity. The loading door 25 is then positioned as shown in FIG. 5 and merchandise can be added up to the level of bracket 30. Finally, the loading door 25 can be locked.

From the description above, it is apparent that the vending machine of the present invention has many advantages. The machine has an entertaining internal display which can rotate above the merchandise and give off an audio sound as the merchandise is vended. Nevertheless, the machine retains a large storage capacity because partition 80 allows merchandise to be stored in the rear of the hopper above the level of the display.

Further, because the height of the merchandise directly over the vending wheel has been reduced, the weight on the vending wheel is reduced, and thus the likelihood of jamming and breakage is less. Moreover, the configuration of the divider walls 64, the brush off plate 65, and the mixing springs 74, also lower the likelihood of breakage and jamming.

By providing hidden wheels 18, the machine can readily be tipped backwards onto the wheels 18 and transported by those who know that the wheels are present, while at the same time hiding the existence of the wheels from the general public. The overall construction also allows for easy changing of displays and for improved loading of merchandise.

The machine is vandal resistant because of the interlocking construction of the parts, and because all the various parts are modular, assembly and repair costs are reduced.

The machine can be manufactured out of conventional vending machine materials such as metals and plastics. It is especially preferred to have the transparent front closure 14 be of an impact resistant plastic, because much vandalism involving vending machines arises as a result of persons attempting to break through transparent enclosures on vending machines.

Although the especially preferred embodiments of the machine bave been described above, it should be appreciated that the invention claimed herein is not so restricted. In this regard, there may be various other modifications and changes to these embodiments which are within the scope of the invention. For example, in some embodiments, the partition member is not used where it is desired to have a very narrow machine. In other applications, it may be desirable to limit the height of the machine, and thus the storage chamber below the dispensing means may be elminated. As such, the invention is not to be limited by the specific description above, but should be judged by the claims which follow.

I claim:

1. In a vending machine having a merchandise chamber for a flowable body of merchandise items, said flowable body being of a selected normal depth, wherein the chamber comprises a bottom wall, a top wall, a vertical front wall that is at least partially transparent, vertical side walls, a back wall, mechanized dispensing means near the bottom of the chamber for dispensing items of merchandise to the exterior of the chamber, and a display member behind the front wall and disposed above the normal merchandise depth, improvement wherein:

the portion of the chamber below the selected normal depth is a lower storage area, and the portion of the chamber above the selected normal depth is an upper chamber;

there is a vertical hopper partition extending between the side walls behind the display member to divide the upper chamber into a front display area and a rear hopper, both of which extend above the normal merchandise depth, the portion of the lower storage area in front of the partition being a lower frontal storage chamber, the lower frontal storage chamber being suitable for storing a plurality of said merchandise items at a selected normal depth below said display member and being at least partially unseparated from said front display area, the bottom of the partition being spaced above the bottom wall a distance corresponding to the normal merchandise depth to limit to that depth the body of merchandise that can flow from the rear hopper into the lower frontal storage chamber and so as to allow for a refilling of the lower frontal storage chamber from merchandise items stored in the rear hopper; and there is a loading aperture near the top of the hopper that allows merchandise to be introduced from the exterior of the machine into the hopper.

2. The vending machine of claim 1, wherein there is a merchandise outlet formed in said bottom wall, and the partition is positioned behind the outlet.

3. The vending machine of claim 1, further comprising:

a loading door having a lower panel section which covers a portion of the loading aperture and an upper panel section pivotably mounted to the lower panel section such that it may be swung from a position closing the remainder of the loading aperture, to a position where the upper panel section forms a feeding chute; and the lower panel section being removable from the aperture so as to allow for removal of the display from the chamber through the loading aperture.

4. The vending machine of claim 3, wherein the partition is mounted on opposed vertical side walls by releasable pivot connections between the lower portion of the partition and the side walls such that the partition may be pivoted rearwardly and downwardly between the opposed vertical side walls and a display which is positioned in front of the partition may then be removed through the loading aperture.

* * * * *